United States Patent [19]

Lambert

[11] 4,332,210

[45] Jun. 1, 1982

[54] AUTOMATIC FLAG SYSTEM

[76] Inventor: William S. Lambert, 52 Tokalon Pl., Metairie, La. 70001

[21] Appl. No.: 138,535

[22] Filed: Apr. 9, 1980

[51] Int. Cl.[3] ..... G09F 17/00

[52] U.S. Cl. ..... 116/173

[58] Field of Search ..... 116/173, 174; 40/470, 40/488, 514, 515, 517; 226/119

[56] References Cited

U.S. PATENT DOCUMENTS

| | | | |
|---|---|---|---|
| 1,359,818 | 11/1920 | Marr | 116/173 |
| 2,579,563 | 12/1951 | Gallinger | 226/119 |
| 3,675,616 | 7/1972 | McInnis | 116/173 |

FOREIGN PATENT DOCUMENTS

| | | | |
|---|---|---|---|
| 656826 | 2/1938 | Fed. Rep. of Germany | 116/173 |

OTHER PUBLICATIONS

Popular Mechanics, p. 162, vol. 98, Issue No. 1, Jul. 1952.

*Primary Examiner*—Kyle L. Howell

*Assistant Examiner*—Denis E. Corr

*Attorney, Agent, or Firm*—C. Emmett Pugh and Associates

[57] ABSTRACT

A flagpole system for automatically displaying and furling a flag employing a motorized drive in which a frictional roller causes the flag to be loosely folded without a spindle into or unfolded from a waterproof cylindrical housing. The system employs both light sensitive and moisture sensitive circuits to automatically activate the DC motor for furling and unfurling the flag. During furling of the flag, when the flag is fully furled, a welt along the side of the flag causes an amperage overload in the motor to take place, activating an amperage overload switch and turning off the motor. At the same time the amperage overload switch reverses the current so that, when the motor is reactivated to lower the flag, the flag will be unfurled. A similar welting overload system is used in the unfurling operation. The drive roller can include uni-directional flicking members on their surface for a flicking action in the furling operation only. The system can be grounded mounted (FIG. 5) or wall mounted (FIG. 9).

11 Claims, 18 Drawing Figures

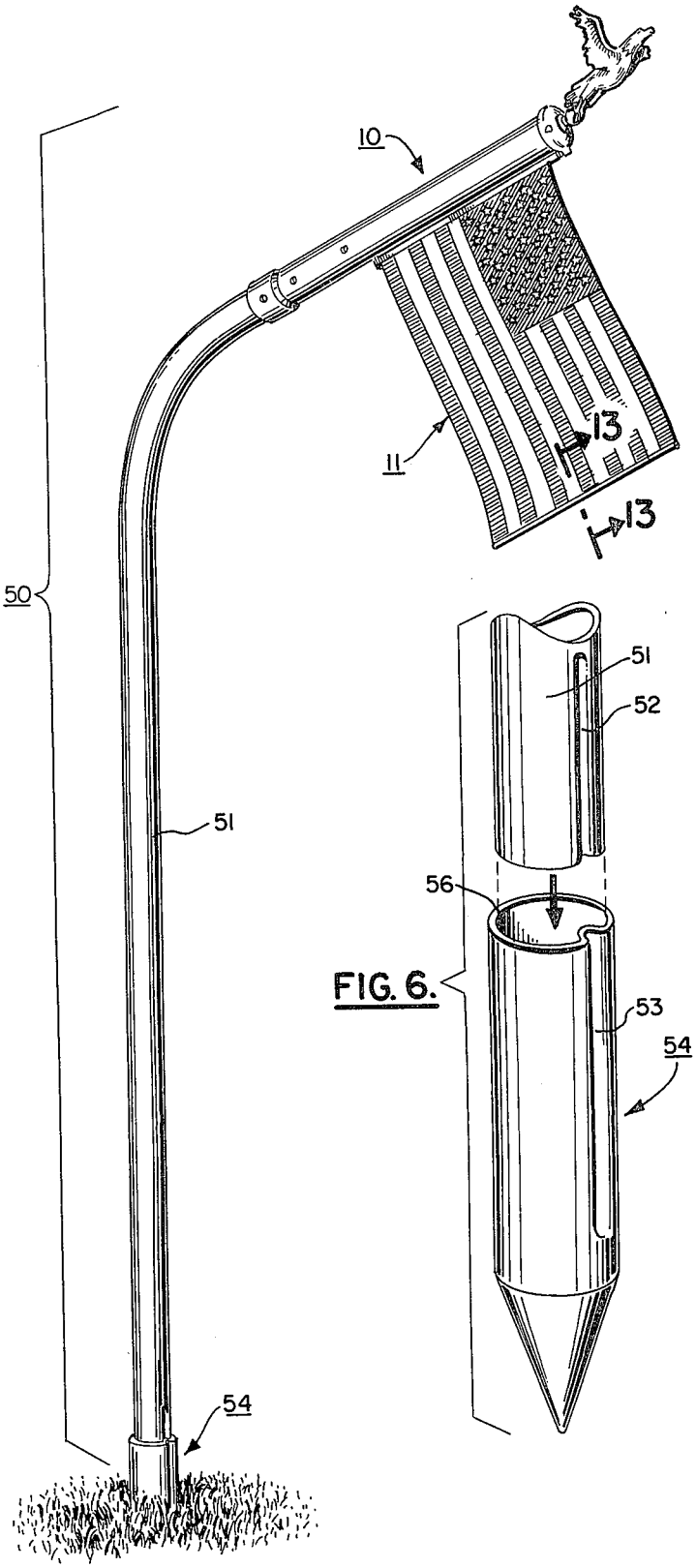
FIG. 5.
FIG. 6.
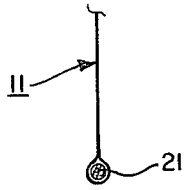
FIG. 13.
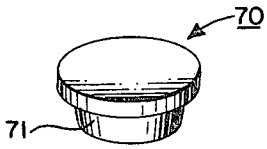
FIG. 7.
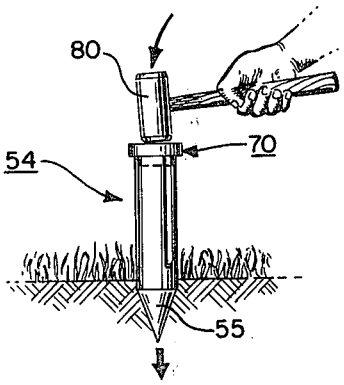
FIG. 8.

AUTOMATIC FLAG SYSTEM

BACKGROUND OF THE INVENTION

1. Field of the Invention

The invention relates to a flag storage and display system which in particular is adopted for automatic operation.

2. Description of the Prior Art

The problem of automatically raising and lowering the flag for both inclement weather and sunrise/sunset has led to several approaches to the problem. In 1921, Frank Zipoy (U.S. Pat. No. 1,373,376 issued Mar. 29, 1921) received a patent on a device which automatically raised or lowered a flag on a standard flagpole, storing the flag below the roof of a building during night hours and inclement weather. The device employed a time switch or clock mechanism to automatically raise and lower the flag for sunrise and sunset and also featured a receptacle into which the collection of moisture would short circuit a pair of contacts, thereby causing the flag to be lowered and stored beneath the roof.

In most of the prior systems, a halyard plays a significant part in the devices. In Robert M. Murdock's system (U.S. Pat. No. 3,923,001 issued Dec. 2, 1975) the halyard forms a closed loop by which, when driven by a pulley, the flag is first drawn downwards into an opening near the pulley, around the pulley and up the opposite side into a storage area. James H. Barnes' device (U.S. Pat. No. 4,079,555 issued Mar. 21, 1978) uses a cable to raise and lower the flag along with double hollow poles, one inside the other, the inner one of which is used to furl or have the flag wrapped around it. The system disclosed in the patent to Theodore F. Schmit (U.S. Pat. No. 3,737,749 issued June 5, 1973) likewise utilizes a halyard type system, along with a photoelectric cell controlled motor.

Two prior systems that break with the halyard concept are George L. McInnis' (U.S. Pat. No. 3,675,616 issued on July 11, 1972) and Clarence H. Martin, et al's (U.S. Pat. No. 3,996,882 issued on Dec. 14, 1976). In McInnis' system, which is horizontal in concept, the relatively complex flag drive subsystem is composed of a hollow tube with threads on the inside to which the flag is attached, a worm screw, and a housing, in which rotary motion serves both to retract and simultaneously furl the flag as it is withdrawn into the housing. In Martin's system, the upper half of the flagpole temporarily pivots 90 degrees to a horizontal position, from which the flag may be furled or unfurled by rolling on unwrapping around a cylinder as it turns.

The problem with the inventions that involves halyards is that they are cumbersome, liable to suffer problems of rope breakage, and in general attack the problem in a "status quo" way. While McInnis' system breaks with the tradition, the device is relatively complex, cumbersome and expensive and is designed only for a horizontal position and is therefore limited as to its applications. Martin's system appears to be the most innovative; however he does not present a completely automatic system, and relys on limit switches which may get out of adjustment to end the furling or unfurling action. Additionally the prior art in general uses a rigid, fixed spindle type system which requires and relies on precise positioning of the flag as it is furled and is also relatively complex and expensive and produces greater maintenance and reliability problems.

It is therefore an aim of the present invention to present an entirely automatic system, which is compact, and as such may be adopted to different usage, has a self-contained power supply, automatic controls for sensing weather and lighting (sunrise/sunset) conditions, allows easy replacement/removal of the flag, approaches the problem of furling, unfurling, and storing the flag in a novel, advantageous fashion, and provides a more accurate, reliable method for furling the flag and to sense that the flag has been furled or unfurled as the case may be.

In summary, it is noted that the following U.S. patents relate to flag storage and display systems, each of which prior patents has been discussed and distinguished above:

| U.S. PAT. NO. | PATENTEE(S) | ISSUE DATE |
|---|---|---|
| 1,373,376 | F. Zipoy | March 29, 1921 |
| 3,675,616 | G. L. McInnis | July 11, 1972 |
| 3,737,749 | T. F. Schmit | June 5, 1973 |
| 3,923,001 | R. M. Murdock | December 2, 1975 |
| 3,996,882 | C. H. Martin | December 14, 1976 |
| 4,079,555 | J. H. Barnes | March 21, 1978 |

BRIEF SUMMARY DISCUSSION OF INVENTION

In specific, the present invention presents a flag system in which the flag is automatically furled and unfurled by means of a motorized drive coupled to a spiral-frictional type roller which is not used as a storage spindle for the flag. The flag pole, in the preferred embodiment, is placed at a non-vertical angle, which is the preferred position for wall deployment, from which the flag, by means of the spiral-frictional roller, may be furled or unfurled in a tangle-free manner. During periods of inclement weather or hours of darkness, the flag is automatically furled and stored in a loose, folded manner inside a waterproofed cylindrical container. The flag system may also be adapted for usage in a horizontal manner as to include for example installation below a mailbox.

The invention allows for easy removal/replacement of the flag and contains its own replaceable or rechargeable voltage (battery) source. Also, along the two terminal ends of the flag, welts are formed, which serve both as a stop to prevent the flag from being furled/unfurled entirely into/from its container, respectively, while simultaneously causing an overload on the motor which is detected and automatically shuts off the motor and reverses the direction of the current preparatory for the next unfurling/furling of the flag.

The invention also contains moisture and light sensors which constantly monitor for inclement weather conditions as well as sunrise/sunset, thereby automatically activating the furling or unfurling of the flag as necessary and desired.

BRIEF DESCRIPTION OF THE DRAWINGS

For a further understanding of the nature and objects of the present invention, reference should be made to the following detailed description taken in conjunction with the accompanying drawings, in which like parts are given like reference numerals and wherein:

FIG. 5 is an overall, perspective view of the entire flag assembly of the embodiment partially shown in FIG. 1, including the flag and a ground supported flag pole for independent free standing usage.

FIG. 6 is a detailed, perspective view of the embodiment of of FIG. 5, in which the ground submerged stake and the slip-in, end portion of the pole, with their corresponding slots to prevent rotation of the pole within the stake, are seen.

FIG. 7 is an overall, perspective view of the protective end cap as used for installation of the stake of FIG. 4, using the method as seen in FIG. 8.

FIG. 8 is a side view showing the installation of the stake of FIG. 6 in which the protective end cap of FIG. 7 is employed to prevent damage to the stake during installation.

FIG. 13 is an end, cross-sectional view of the welding of the flag taken along section lines 13—13 of FIG. 5.

DETAILED DESCRIPTION OF THE PREFERRED EMBODIMENTS

The preferred application of the preferred embodiment is a system for automatically displaying and protectively storing the flag, such as for example the American flag or other state flag or penant. The system as such, is completely automatic, and has its own self contained rechargeable voltage source. The system of the preferred embodiment features the housing preferably to be mounted at an angle off the vertical, particularly in wall installations, and has a vertical pole, featuring an angularly located housing embodiment for free standing usage. The system can also be adapted for horizontal placement, as for example below a mailbox.

Figures 1, 1A:
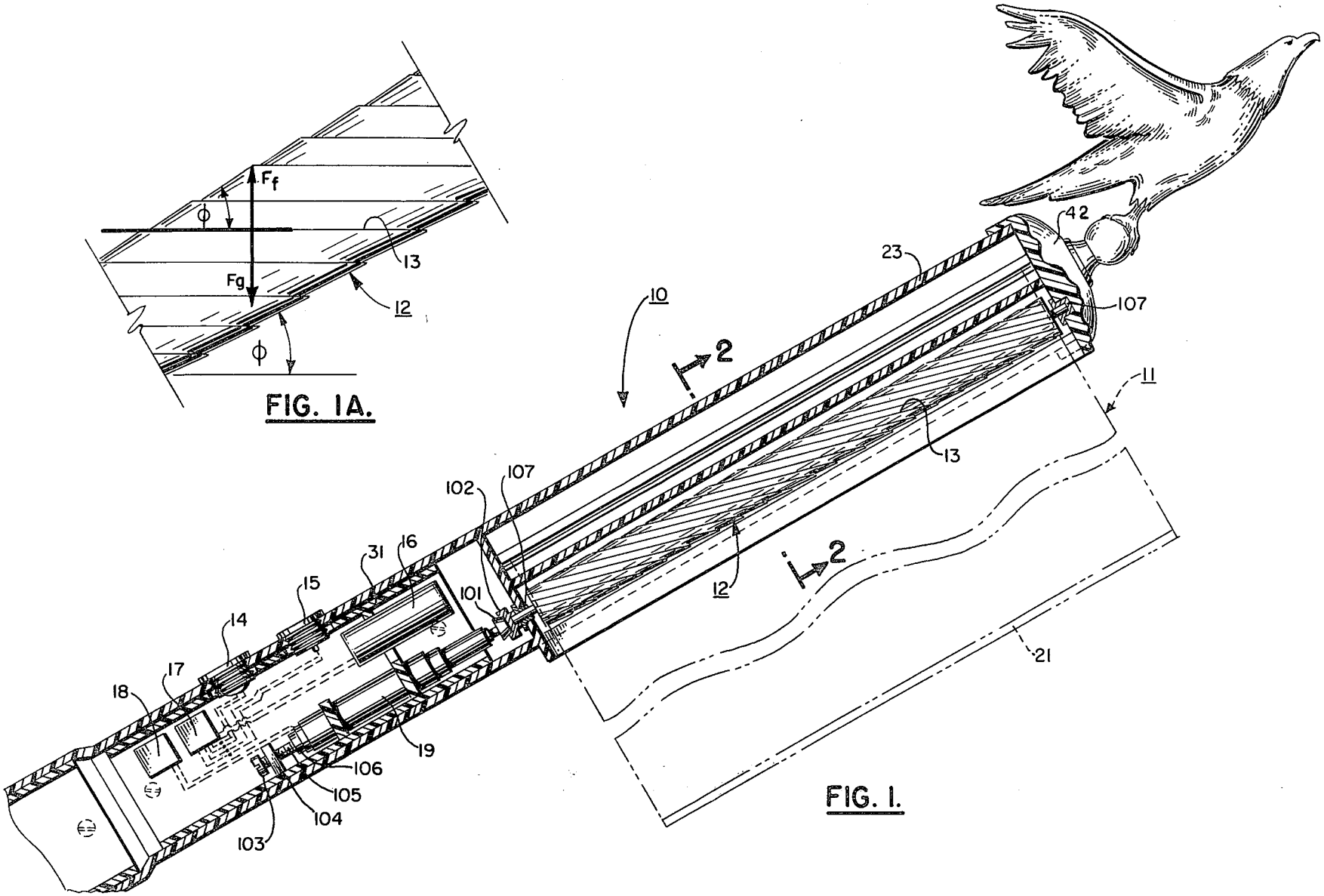
FIG. 1 is a side, cross-sectional, partial view of the preferred embodiment of the present invention showing the spiral roller and motorized frictional drive system thereof, moisture switch, photo cell, battery, and amperage overload-reverse relay switches.
FIG. 1A is a detail of the roller of FIG. 1 showing the lines of action of gravity, the "F" force of friction, and the angle phi ($\phi$).

In FIG. 1 a cross-sectional view of the housing 10 is seen. The housing 10 is preferrably cylindrical, as shown, and can be made of a durable, shatter-proof plastic material, such as that for example used for making sewer and water pipes, whose coloration is preferrably resistant to ultra-violet rays.

The flag 11 is furled or unfurled with respect to the housing 10 by the rotating, surface driving action of a spiral-friction roller 12, which can be made for example of cast rubber. By the formation of the spirals 13 on the roller 12, sagging and wrinkling of the flag 11 during furling is prevented. In order to enhance the flicking action (discussed more fully below with respect to FIG. 12), the spiral sections 13 can be angularly cut into at spaced lines along their lengths to create individually moveable, flicking flaps along the spiral ridges 13.

During operation, the sensing system composed of moisture switch 14 and photo cell 15 are continually sensing the ambient conditions. When the flag 11 is in the unfurled position, moisture on moisture switch 14 or lack of sunlight illumination on photo cell 15 due to impinging darkness, will cause the flag 11 to be furled. As moisture switch 14 or photo cell 15 is activated causing relay 17 to be activated, current will flow from the battery 16 and by means of amperage overload-reverse current switch 18 be caused to flow in such a direction through DC motor 19 as to cause roller 12 to rotate in bearings 107 and furl the flag 11.

For DC motor 19 to cause roller 12 to rotate, conical driver 101 must have enough frictional contact with friction wheel 102 so as to transmit rotary motion from the motor 19 to the roller 12. To accomplish this, compression screw 103, as illustrated, is provided. Screw mount 104 is fixed in place. As compression screw 103 is turned in a clock-wise manner for right hand threads, the tip 105 of the screw will bear against the end 106 of the motor 19 passing, due to the rigidity of the motor housing, the compression force to the conical driver 101. This compresses the conical drive surface against the female surface of the friction wheel 102, increasing the surface friction and therefore the frictional force and allowing conical driver 101 and friction wheel 102 to turn as one unit, passing the rotary motion from the motor 19 to the roller 12.

As such, the thrust bearings 107 serve not only as a mount for the roller assembly 12 to rotate in, but also to take the thrust loads derived from the compression force which maintains the frictional contact between driver 101 and wheel 102. It is noted that conical tolerances are included for wear.

As an alternate to the compression screw 103, the alternate spring embodiment of FIG. 14, discussed more fully below, may be inserted as an exemplary construction in place of the screw mount 104 at the end 106 of the motor 19. This spring, discussed below, will maintain a sufficient compressive force between driver 101 and wheel 102, thereby eliminating the need to periodically adjust any compression screw 103.

Figures 3, 14, 15:
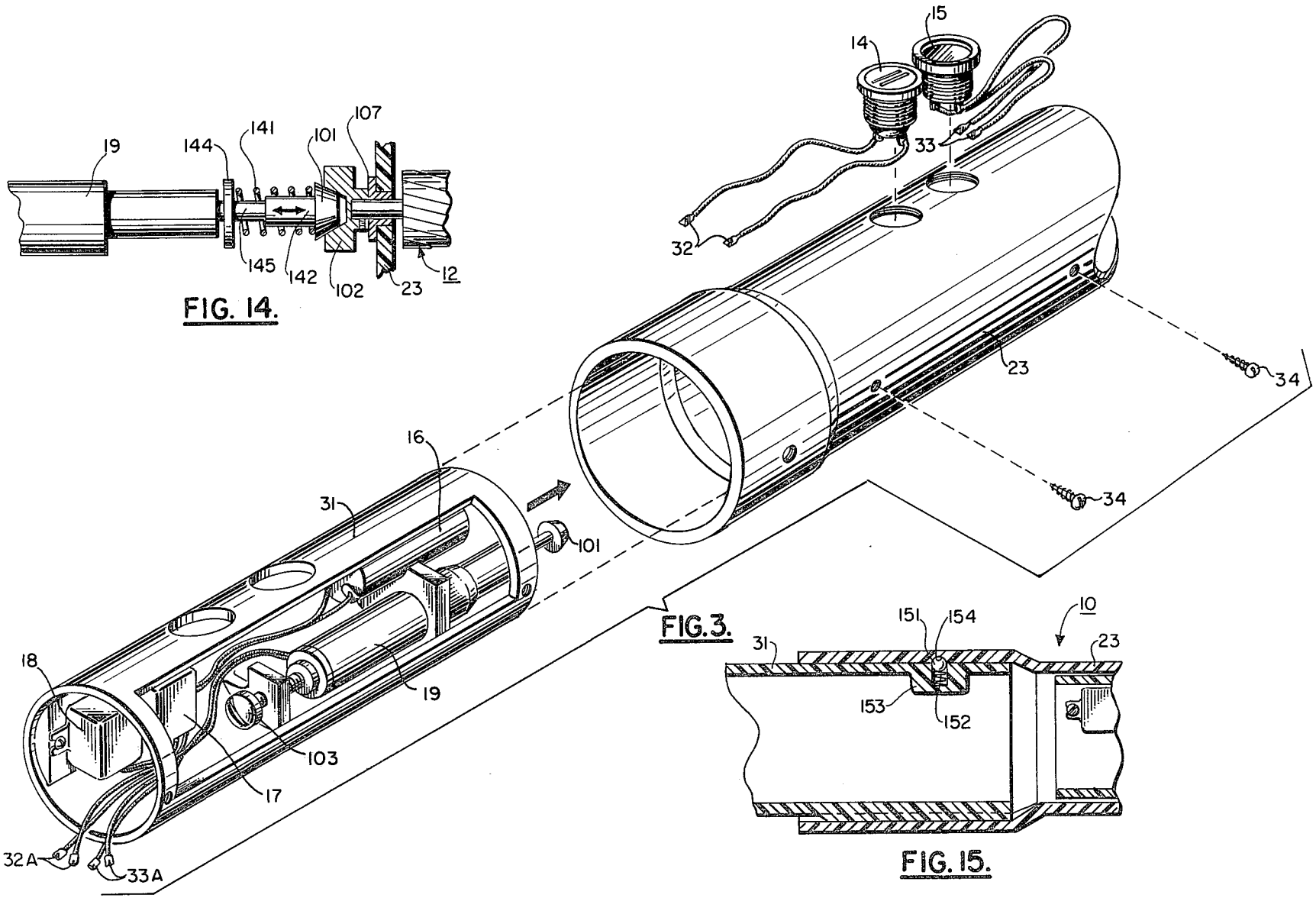
FIG. 3 is an exploded, rear-perspective view of the moisture and light sensor, the motorized drive system, the battery, and the amperage overload-reverse relay switch elements of the preferred embodiment of FIG. 1, in which the general positioning of the parts is seen, as well as a method for attaching the flag housing to its support column is seen.
FIG. 14 is a side, partial, cross-sectional view of an alternate motor-to-friction-wheel connection of the one shown in the preferred embodiment of FIG. 1.
FIG. 15 is a side, partial, cross-sectional view of an alternate, quick slip-on connection showing the connection of the casing of the housing as it connects to the bottom pole or section.

In FIG. 14, this alternate tension spring embodiment to the compression screw 103 is seen. Conical driver 101 is fixedly attached to keyed sleeve 142, which is able to longitudinally slide on motor shaft 145. The keying of the sleeve 142 and the shaft 145 serves to allow conical driver 101, keyed sleeve 142, and motor shaft 145 to turn as one unit while allowing axial, telescoping movement of the driver 101 and sleeve 142. The tension spring 141 is compressed between shoulder 144, which is affixed to the shaft, and the rear surface of the rubber, conical driver 101, compressing driver 101 against the friction wheel 102. Tension spring 141, as such, serves to maintain a compressive force between conical driver 101 and friction wheel 102, allowing a sufficient frictional force to be maintained between the driver 101 and wheel 102, causing them to rotate as one unit.

Sagging and wrinkling of the flag 11, during furling is prevented by the spiral-friction roller 12 as previously mentioned. As such (detailed in FIG. 1A), the cast rubber roller 12 is formed in a series of spirals 13 of which the angle phi ($\phi$), as formed with the horizontal, will preferably be the same as the angle with which the roller 12 forms relative to the horizontal. This arrangement allows the maximum frictional force ($F_f$) to be developed parallel to the force of gravity ($F_g$). This force is therefore developed at an angle 90-0 to the axis of the roller 12 and effectively prevents wrinkling of the flag 11 during furling.

Figure 2:
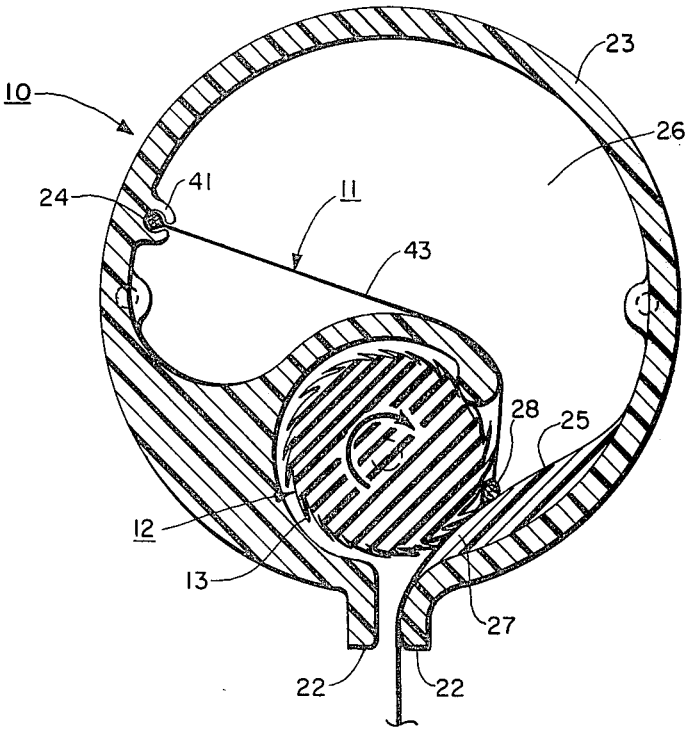
FIG. 2 a cross-sectional view taken along section lines 2—2 of FIG. 1 showing the cylindrical, flag storage chamber, the frictional roller and the flag fully unfurled.
Figure 2A:
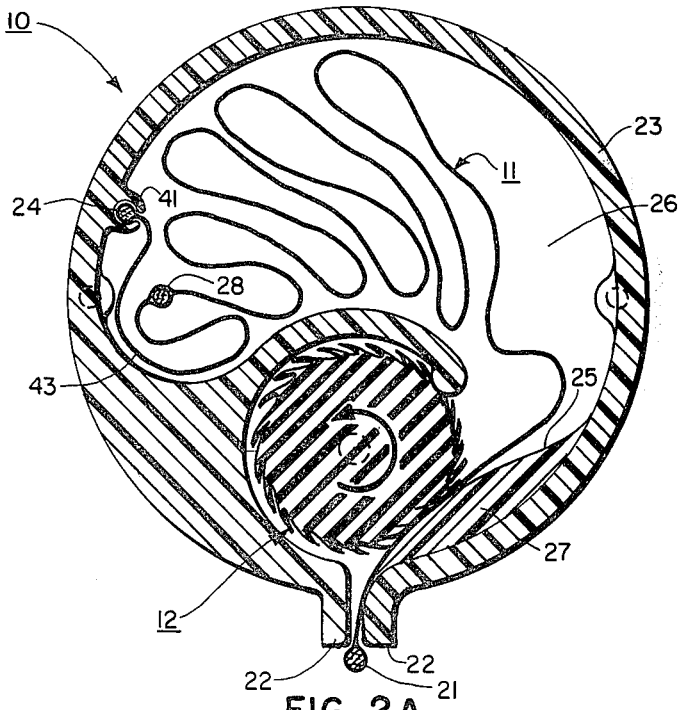
FIG. 2A is a cross-sectional view identical in perspective to FIG. 2 but with the flag fully furled, in which the flag as furled is shown loosely folded with the welt stopping the inward motion of the flag.

As furling of the flag 11 is completed, welt 21 (see also FIG. 13) will make contact with the lips 22, as best seen in FIG. 2A, thereby preventing roller 12 from turning, in turn inducing motor 19 to consume a higher amperage current. This is "read" as an amperage overload by the amperage overload-reverse current switch 18, which in turn simultaneously opens relay 17, cutting off current to the motor 19, and reverses the circuit so that during the next operation, unfurling, the motor 19 will be caused to turn in the appropriate, opposite direction and unfurl the flag 11.

The lips 22 of the casing 23, which are best seen in FIGS. 2 and 2A, may alternatively be formed with a hemispherical cutout (unillustrated) so as to retain and cover over the welt 21 and prevent any wind action from causing the flag 11 to unfurl.

During furling of the flag 11, as best seen in FIG. 2A, the counterclockwise turning of roller 12 will cause the flag 11 to be furled and a loose folding action will take place as the body of the flag 11 is stored.

As can be seen in FIG. 2A, the flag 11 lies loosely within the housing and is not rolled up on a spindle, as is usually the case in prior art systems. Surface 25 of shoulder 27 has a non-frictional coating, which in an exemplary manner could be "Teflon," which allows flag 11 to slide on surface 25 while maintaining frictional contact with roller 12. Because the opposing normal force of the roller 12 and the surface 25 exist due to compressing roller 12 against the surface 25 of the shoulder 27, frictional forces which prevent the sliding of the flag 11 on the roller 12 exist. Due to this type of construction, the need for a double roller system to furl and unfurl the flag is not necessary. Also, as previously discussed, the spiral edges 13 maintain even furling of the flag 11 across the width of the roller 12 and prevent wrinkling of the flag 11.

When the flag 11 is in the furled position, the combination of daylight illumination on photo cell 15 and the lack of moisture on moisture switch 14 will cause the flag 11 to be unfurled. As unfurling takes place, the flag 11 will be unfolded. When the flag 11 becomes fully displayed, welt 24 located in slot 41, in combination with welt 28, which when contacting both the roller 12 and shoulder 27, will prevent further unfurling of the flag 11, thereby preventing roller 12 from turning. This causes motor 19 to draw more amperage, resulting in switch 18 opening relay 17, thereby cutting off current to motor 19 while simultaneously reversing the circuit so that during the next operation the flag 11 can be furled. Welt 28 in this type of arrangement serves to prevent tension and tearing from taking place in the hidden area 43 of the flagg 11.

In FIG. 3, an exemplary method of joining the casing 23 of the housing 10 to the bottom pole or section 31 is seen. As the casing 23 is withdrawn, easy access to the motor 19, battery 16, etc. contained therein is obtained by means of the cutout section. This allows for easy replacement of parts as well as adjustment of compression screw 103. Also seen are the moisture sensor 14 and photo cell 15. These, preferably, are threaded and have snap connections 32 and 33 which mate with connections 32A and 33A, respectively, allowing easy replacement of the parts if failure of either occurs. Additionally having such easy access to the bottom section of the housing 10 allows for the ready inclusion and accessability to a battery charging accessory (not illustrated). With such an adaption, the housing 10 could be easily removed and taken indoors for pluging into an over night battery charger.

In an exemplary manner, screws 34 are used for joining the sections 23 and 31 together, although other means such as for further example a spring and ball or a twist connection may also be used.

As an alternate, the housing 10 can be joined to the pole or section 31 by means of a ball and socket connection such as that which is illustrate in FIG. 15. In this type of quick slip-on means, casing 23 is formed with a hemispherical area 154 for receiving the ball 151 when the housing 10 is inserted over the pole or section 31. The pole of section 31 is formed with built up section 153 which retains the ball 151 and spring 152. The spring 152, which maintains a force against the ball 151, maintains the housing 10 in place on the pole or section 31; while allowing when a sufficient axial force is applied to the housing 10, removal and installation of the housing 10 on the pole or section 31.

Figure 4:
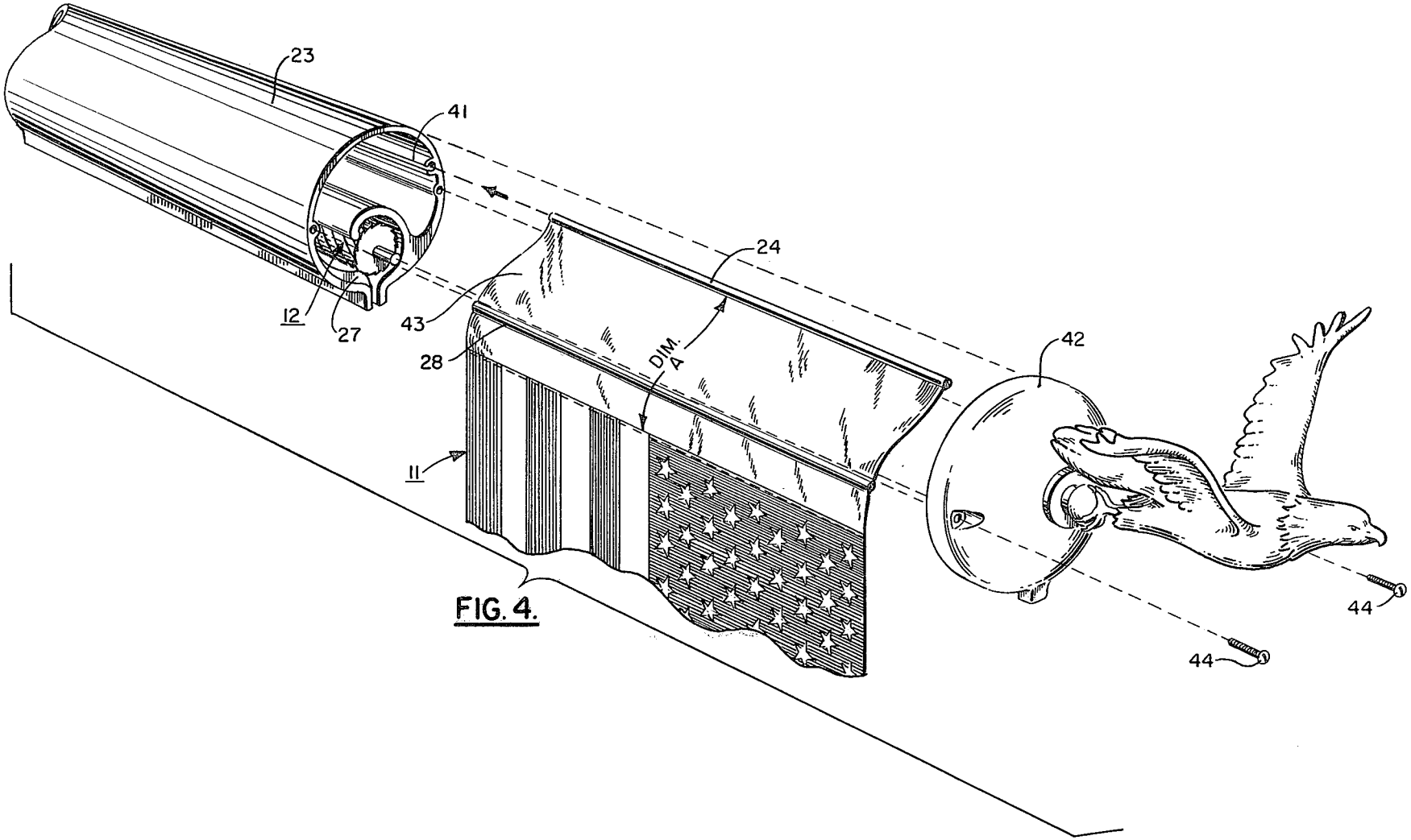
FIG. 4 is an exploded, front-perspective, partial view of the flag housing, flag, and housing end cover elements which shows the method of installation of the flag.

In FIG. 4, an exploded view showing the replacement/installation of the flag is seen. End cap 42, which may or may not be decorative in nature, is removed by unscrewing screws 44, whereupon end cap 42 can be removed, allowing flag 11 to be easily replaced. In this type of construction the welt 24 serves a double purpose; both holding the flag in place, while allowing easy insertion/removal via channel 41, and, by the fixing of one end of the flag to the casing 23, the tension created on the flag 11 upon complete unfurling will cause an amperage overload condition to exist and shut off the motor 19. Of course the cap 42, rather than having securement screws 44, could be provided in the manufacturing process with a "snap-cap" type configuration in its mating with the housing 10.

As also seen in FIG. 4, the flag 11 is to be constructed in a manner in which "add-on" area 43 serves, as the flag 11 is displayed, to prevent any of the flag 11 from being hidden inside the casing 23. The flag can be made of for example a polyester material or other material which is high heat fusible. With such a fusible material the welts 21, 24 and 28 can be formed by heat fusing the material rather than by serving or stitching.

For installing the flag 11, the welt 24 is inserted in channel 41 and slid rearwards. With the cover 42 removed, the end of roller 12 is free and pressure is released, allowing the flag 11 to slide between it and the shoulder 27, along the non-friction surface 25 of the casing 23. It is noted that the roller socket 107 (FIG. 1) in the end cap 42 could have a larger, wedge entry into it for easier insertion and stabbing of the entry of the male axis pin of the roller 12.

In FIG. 5 a free standing flagpole system 50 is seen. In this sytem, the pole 51, which is angled at its top section at a large radius for appearance and best flag display purposes, serves as a mount for the flag housing 10. The pole 51 can be integrally formed with red, white, and blue stripes along its sides or such stripes, if so desired, can be added by means such as spray painting. Pole 51, as best seen in FIG. 6, has slotted section 52, which mates with a like slot 53 in the base or stake section 54, thereby preventing pole 51 from turning during windy conditions. This also allows for the removal of the flagpole system 50 during extreme wind conditions as well as movement to another locale.

In FIG. 8 installation of the stamp-formed stake section 54 is seen. With stake 54 held in a vertical position, striking the stake 54 with a hammer 80 will drive the pointed end 55 into the ground. To prevent damage to the lip 56 (see FIG. 6) of the stake 54, impact surface tool or plug 70 is employed (see FIG. 7). The swaged, projecting surface area 71 of the plug 70 is inserted inside the lip 56 of the stake 54, thereby preventing damage to the lip 56 by evenly spreading the force of the hammer blow over the lip 56 of the stake 54, preventing stress risers.

Figures 9, 10:
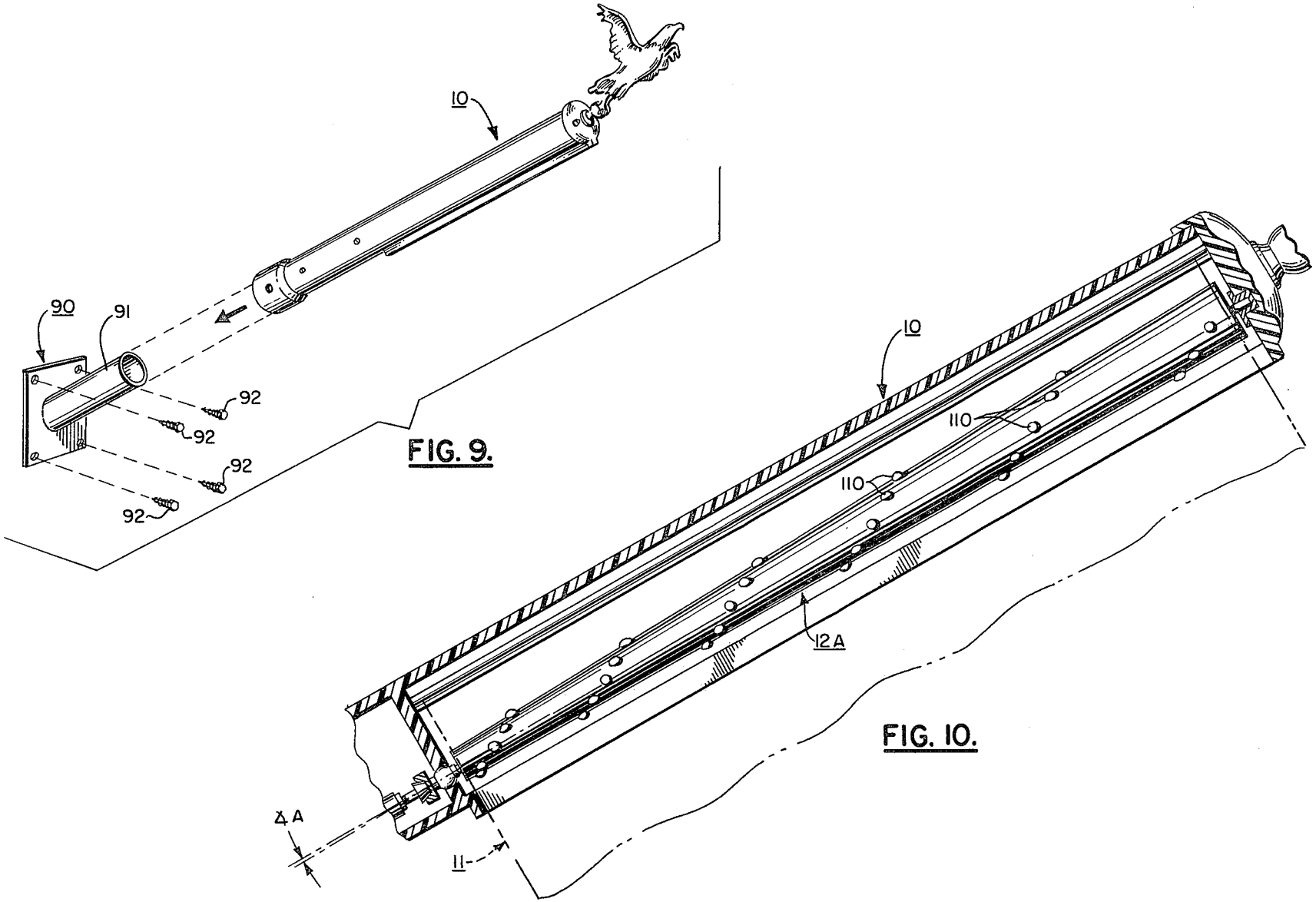
FIG. 9 is an exploded, overall, front-perspective view of the preferred embodiment of FIG. 1, but with its housing and angled support bracket adapted for wall installations as another exemplary application as an alternative to that of FIG. 5.
FIG. 10 is a side, cross-sectional view of an alternate embodiment of the preferred embodiment of FIG. 1 in which the spiral-cylindrical frictional roller has been replaced with a conical frictional roller in which spirally placed knobs or surface projections are instead used.

In FIG. 9 an overall, exploded view of the preferred embodiment adapted for wall or building installation is seen. Support 90, to which tubular section 91 may be placed at an angle to the horizontal, is shown attached by screws 92 in an exemplary manner, although a cement such as epoxy may also be used.

In FIG. 10, an alternate embodiment of the roller 12A is seen. In this embodiment, knobs or tits 110 are used instead of the spiral ridges 13 of the roller of FIG. 1. As such, the tits 110 have the same function as the spirals 13 and prevent wrinkling of the flag 11.

Figure 11:
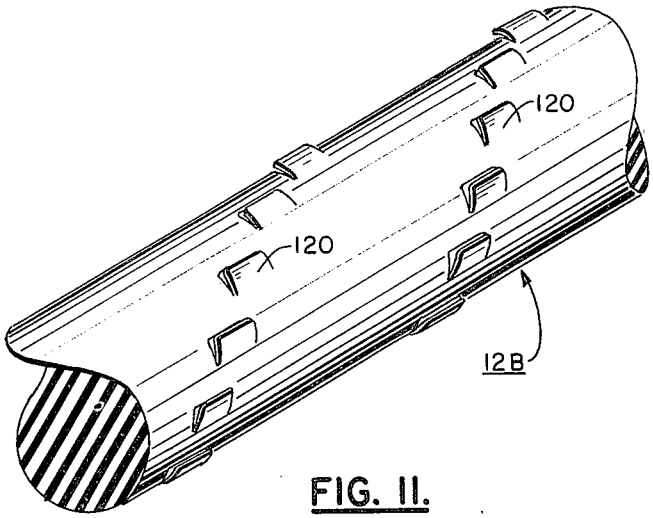
FIG. 11 is a front-perspective, partial view of an alternate embodiment of the roller of FIG. 10 in which flaps are used instead of knobs as the surface projections.
Figure 12:
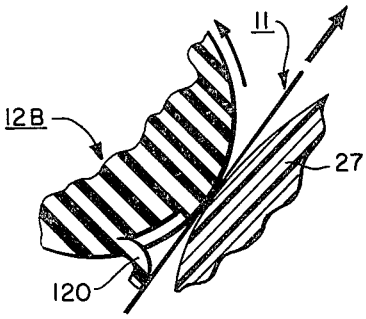
FIG. 12 is a side, cross-sectional view of the roller of FIG. 11 and its opposing surface showing the operative, flicking action of the flaps of FIG. 11 during the furling operation.
Figure 12A:
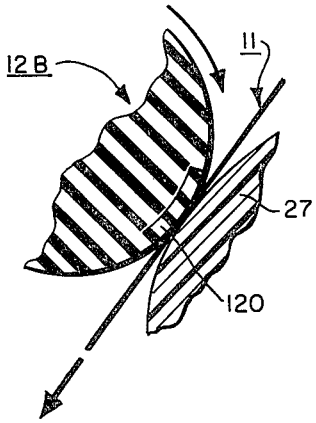
FIG. 12A is a side, cross-sectional view similar to that of FIG. 12 but showing the relatively ventral action of the flaps of FIG. 11 during the unfurling operation.

An alternate to the tits 110 is seen in FIG. 11. Flaps 120 are employed, spiraled around the roller 12B, again to aid in preventing wrinkling of the flag 11 during furling. In the furling operation, the resilient, flexible flaps 120, as seen in FIG. 12, fold backwards, and, by increasing the contact pressure as they come in contact with the shoulder 27 of the casing 23, they assist in their flicking action in preventing wrinkling of the flag 11. During unfurling, the roller 12B turns in the opposite direction, as illustrated in FIG. 12A, and the flaps 120 lie in their flat, normal, neutral positions, as no additional rolling friction is necessary.

A further alternative to the flicking flaps 120 is a roller (unillustrated) with resilient, flicking bristles similar to that of a roller assembly found in floor sweeps and vacuum cleaners. The action of the bristles here, is that, as they contact the flag, they will bend and flex and help prevent the flag from wrinkling, as well as assist in the flicking and the folding of the flag into its storage area.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed is:

1. An automatic flag display system, comprising:

a flexible sheet of material upon which flag-like display indicia is disposed;

extended hollow flag storage compartment means which is at least generally impervious to the weather elements for storing said sheet in a flat, loosely furled form, the interior end of said sheet being fixedly attached in the interior of said storage compartment means;

a longitudinally extended bottom opening in said storage compartment through which the exterior end of said sheet projects; and longitudinally extended drive means associated and aligned with said bottom opening for furling and unfurling said sheet, said sheet in its furled disposition being loosely stored flat with folds parallel to the direction of the longitudinal expanse of both said opening and said drive means and loosely folded in the direction normal to said longitudinal expanse within said storage hollow compartment means.

2. The flag display system of claim 1, wherein said drive means includes a driven, rotatable drive roller located within said storage compartment adjacent to said opening which frictionally engages said sheet for furling and unfurling it as said drive roller is rotated.

3. The flag display system of claim 2, wherein said sheet includes two raised welts, an exterior one located at said exterior end of said sheet and an interior one located toward said interior end and within said storage compartment means, said exterior welt having a width greater than the lateral width of said opening, preventing said exterior end from going completely into said storage compartment means when said sheet is furled, and said interior welt preventing said sheet from being driven totally out of said storage compartment means when said sheet is unfurled.

4. The flag display system of claim 3, wherein said interior welt is located at the very interior end of said sheet, and wherein the body of said storage compartment means includes in its interior a longitudinally extending fixed channel having an interior size to accomodate but hold said interior welt, said interior welt being positioned in said channel and thereby being fixed to the interior body of said storage compartment means.

5. The flag display system of anyone of claims 1 or 4, wherein said storage compartment is basically cylindrical in shape, with said drive means being located longitudinally down the length of said compartment above said opening, with the rest of the interior of said compartment including an open and unrestricted area, said open and unrestricted area comprising more than half of the lateral cross-sectional area within said storage compartment and comprising the area in which said sheet is folded and loosely furled.

6. The flag display system of claim 5, wherein said drive means further comprises a DC motor and battery located at the lower end of said storage compartment means.

7. The flag display system of claim 1, wherein there is further included angled support means attached to said storage compartment means for supporting said storage compartment at an angle off the vertical.

8. The flag display system of claim 2, wherein said drive means further includes a static drive surface opposed to said drive roller, said sheet passing and being compressed between said drive roller and said drive surface.

9. An automatic flag display system, comprising:

a flexible sheet of material upon which flag-like display indicia is disposed;

a hollow flag storage compartment which is at least generally impervious to the weather elements for storing said sheet, the interior end of said sheet being fixedly attached in the interior of said storage compartment;

a bottom opening in said storage compartment through which the exterior end of said sheet projects; and drive means associated with said bottom opening for furling and unfurling said sheet, said sheet in its furled disposition being stored loosely folded within said hollow storage compartment;

said drive means including a driven, rotatable drive roller located within said storage compartment adjacent to said opening which frictionally engages said sheet for furling and unfurling it as said drive roller is rotated;

said drive means further including a static drive surface opposed to said drive roller, said sheet passing and being compressed between said drive roller and said drive surface.

10. The flag display system of claim 9, wherein said drive roller includes a series of surface protrusions for enhancing the frictional driving engagement of said drive roller on said sheet.

11. The flag display system of claim 10, wherein said surface protrusions comprise flexible, radial extension means angularly extending out from and along the general exterior surface of said drive roller in a direction toward the interior of said compartment as it approaches said static drive surface for causing a flicking action on said sheet when said drive roller is rotated in the furling direction but less flicking action when said drive roller rotates in the unfurling direction.

* * * * *